United States Patent [19]

Miller et al.

[11] Patent Number: 4,913,202

[45] Date of Patent: Apr. 3, 1990

[54] FILLING PACKAGING CONTAINERS

[75] Inventors: John D. Miller, Churchdown; Peter D. Hardy, Wantage, both of United Kingdom

[73] Assignee: CMB Packaging (UK) Limited, Worcester, United Kingdom

[21] Appl. No.: 222,920

[22] PCT Filed: Oct. 8, 1987

[86] PCT No.: PCT/GB87/00711

§ 371 Date: Jul. 12, 1988

§ 102(e) Date: Jul. 12, 1988

[87] PCT Pub. No.: WO88/02722

PCT Pub. Date: Apr. 21, 1988

[30] Foreign Application Priority Data

Oct. 14, 1986 [GB] United Kingdom ..... 8624595

[51] Int. Cl.[4] ..... B65B 3/32; B65B 55/02; B67D 1/08

[52] U.S. Cl. ..... 141/258; 141/90; 141/91; 141/104; 141/174; 141/261; 141/259; 222/135; 222/148; 222/255

[58] Field of Search ..... 141/89–92, 141/258–262, 100, 104, 105, 106, 31, 173, 174, 129; 222/255, 265, 275, 278, 280, 148, 135, 145

[56] References Cited

U.S. PATENT DOCUMENTS

| | | | |
|---|---|---|---|
| 2,427,429 | 9/1947 | Waite et al. | 417/318 X |
| 2,923,438 | 2/1960 | Logan et al. | 141/104 |
| 3,949,746 | 4/1976 | Wallach | 141/258 X |
| 4,273,263 | 6/1981 | Voegele et al. | 222/148 |
| 4,437,498 | 3/1984 | Pankratz et al. | 141/89 |
| 4,569,378 | 2/1986 | Bergandy | 141/89 X |
| 4,667,709 | 5/1987 | Fischer et al. | 141/91 |
| 4,699,297 | 10/1987 | Raque et al. | 222/148 |
| 4,711,277 | 12/1987 | Clish | 141/311 A |

FOREIGN PATENT DOCUMENTS

| | | |
|---|---|---|
| 2593580 | 7/1987 | France . |
| 389437 | 7/1965 | Switzerland . |
| 2089440 | 6/1982 | United Kingdom . |

*Primary Examiner*—Ernest G. Cusick

*Attorney, Agent, or Firm*—Christie, Parker & Hale

[57] ABSTRACT

A machine for filling packaging containers with a flowable product comprises a control valve in the form of a plug valve having a body defining a bore forming a frusto-conical valve seat, a plug having a complimentary frusto-conical surface, and a valve chamber for pressurized fluid formed at the wider end of the plug. The chamber communicates with the bore. The plug is axially displaceable between a first position, in which the frusto-conical surface seals against the valve seat and in which it is rotatable to control flow through the valve, and a second position, in which it is withdrawn into the chamber to provide clearance between the mating surfaces of the plug and the seat but retaining clearance between its wider end and the opposite surface of the chamber so that all surfaces of the plug are exposed for cleaning and sterilization.

6 Claims, 7 Drawing Sheets

FILLING PACKAGING CONTAINERS

BACKGROUND OF THE INVENTION

This invention relates to a machine for filling packaging containers with a flowable product. The product is preferably a mixture of at least two flowable components. Only two components will be mentioned hereinafter for the sake of clarity. The product may consist of a first component in the form of a particulate solid material suspended in a viscous liquid (hereinafter: solids), and a second component in the form of a thin liquid, e.g. water (hereinafter: liquid), each component being supplied from a separate source. Naturally both the components could be liquids but the terms "solids" and "liquid" will be used for simplicity of description. Examples, among foodstuffs, of products suitable for packaging according to the invention include heterogeneous petfood products and soups containing solid matter such as pieces of vegetables.

The invention is very suitable for aseptic filling processes, using containers of synthetic plastics, rigid, semi-rigid or flexible.

The aim of the invention is to avoid or at least to mitigate the disadvantages of known filling machines, some of which will be mentioned hereinafter.

SUMMARY OF THE INVENTION

The invention provides a machine for filling packaging containers with a flowable product, the machine comprising a control valve in the form of a plug valve having a body defining a bore forming a frusto-conical valve seat, a plug having a complementary frusto-conical surface, a valve chamber for pressurized fluid being formed at the wider end of the plug, the chamber communicating with the bore, the plug being axially displaceable between a first position, in which its frusto-conical surface seals against the valve seat and in which it is rotatable to control flow through the valve, and a second position, in which it is withdrawn into the chamber to provide clearance between the mating surfaces of the plug and the seat but retaining clearance between its wider end and the opposite surface of the chamber so that all the surfaces of the plug are exposed for cleaning and sterilization.

An important advantage of a filling machine having a valve designed as stated above is that when the plug is in the withdrawn position the whole valve can be thoroughly cleaned and sterilized without having to be dismantled. A further advantage is the ability of the above plug valve to compensate for any differential expansion of the plug and its valve seat by the axial adjustability of the plug built into the design of the valve. This is of particular advantage when the seat defining body and the plug are made of materials having different coefficients of thermal expansion.

A further advantage of the plug valve is that the plug and its seat are able to survive abrasive attack by relatively hard particles in the products being filled by the machine, e.g. bone or gristle. Such particles have a damaging effect on prior art valves sealed by elastomeric O-rings which are vulnerable to the action of such particles, particularly when an "O" ring is slid past a port during dismantling and assembly.

In a preferred embodiment the machine comprises conduit means communicating with the valve chamber for leading the pressurized fluid into and/or out of the chamber. Preferably the conduit means serve for leading the pressurized fluid into the chamber, and the fluid leaves the chamber through the clearance between the plug and its seat.

In a further preferred embodiment the machine comprises a first and a second pump for pumping, respectively, a first and a second component of said product, respective flow paths for the components between the pumps and respective sterile sources of the components and between the pumps and a common outlet for filling the containers, wherein the plug valve is constructed and situated to control the flow of the components through the flow paths and is angularly displaceable between a first position in which the first pump is in a discharge mode and discharges the first component via the plug into the outlet, and the second pump is in a suction mode and fills itself with the second component via the plug, and a second position in which the operation of the pumps is reversed.

Preferably each of the pumps is a singleacting reciprocating piston pump which comprises a cylinder, a main piston and an auxiliary piston carried by a common piston rod, wherein the cylinder is fluid-tightly divided by a rolling diaphragm into a main part containing the main piston and an auxiliary part containing the auxiliary piston, the periphery of the rolling diaphragm being attached to the cylinder and a central portion of the diaphragm is attached to the auxiliary piston to be displaced thereby.

In an advantageous embodiment the main part of the cylinder has a pumping portion the diameter of which is complementary to the diameter of the main piston, and a withdrawal portion which merges into the pumping portion but is of a larger diameter than the latter, the pump being so designed that in its pumping mode the main piston is reciprocable within the pumping portion, while outside the pumping mode the main piston may be withdrawn into the withdrawal portion where all its surfaces are exposed for cleaning and sterilization.

DRAWINGS

The invention will now be described, by way of example only, with reference to the accompanying diagrammatic drawings showing an aseptic filling machine for filling a succession of plastics pots with a product, the machine comprising two piston pumps and a plug valve. In the drawings.

DETAILED DESCRIPTION

Figure 1:
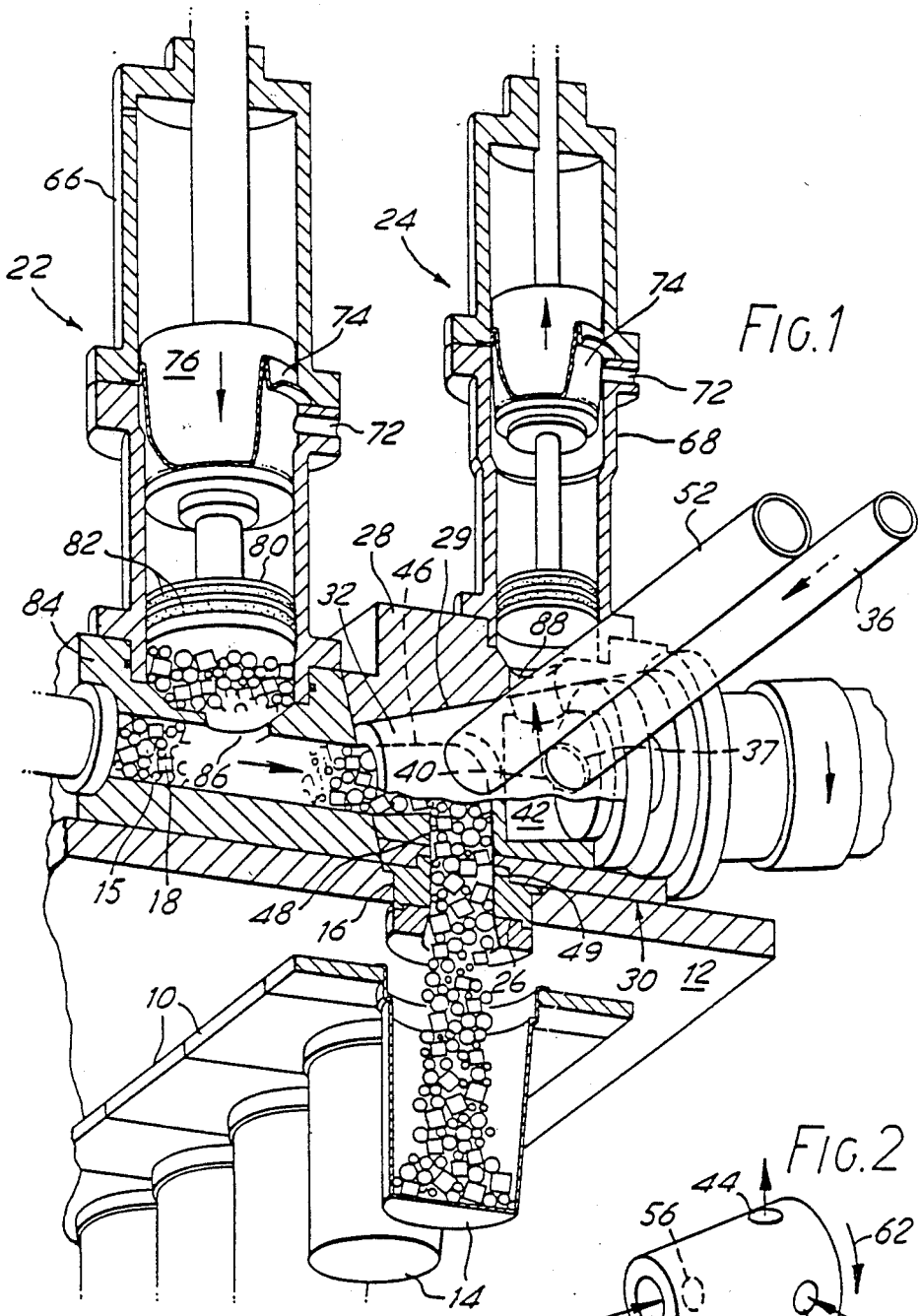
FIG. 1 is a simplified cut-away isometric view of the machine in its solids filling mode.

At the filling station (FIGS. 1 and 3) an indexing conveyor (not shown) carries a series of pot carriers 10 horizontally, below a main baseplate 12 of the aseptic filling machine. The region below the baseplate 12 is enclosed and supplied with sterile air so that the pots 14 receive the product components through a filling nozzle 26 which has a vertical axis, is provided with a flared outlet and is mounted in a hole 16 in the baseplate 12 in a sterile environment. However the outlet need not necessarily be flared as shown; for example a cylindrical outlet may be used. The product components reach the nozzle 26 through the sterilized interior of the machine, which is mounted on top of the baseplate 12.

The product components, namely the solids 18 and liquid 20 (both as hereinbefore defined) are supplied sequentially to the pot 14 by a reciprocating solids metering pump 22 and liquid metering pump 24, and do not become mixed until the liquid is added to the solids already in the pot 14. Each of the pumps 22, 24 is substantially a single-acting piston pump.

The machine includes a rotary plug valve 30 (FIGS. 1, 3, 5, 8 and 9) which acts both as a control valve and a cut-off valve. The valve comprises a body or housing 28 provided with a tapered bore 29 which forms a frusto-conical valve seat accommodating a complementarily tapered plug 32 to enable a plain surface-to-surface sealing between ports without the use of additional elastomeric seals. If desired, an "O" ring or other elastomeric seal may be provided adjacent the wider end of the conical plug wall because, in this location, it will never have to pass a port during assembly or dismantling. The tapered bore 29 is open at its small-diameter front end and extends axially past the plug 32 at its large-diameter rear end where it is closed by a plate 38, whereby a valve chamber 31 is formed behind the plug 32. The plug 32 has a stem which passes through the chamber 31 and serves for angular and axial displacement of the plug 32 as hereinafter explained. A channel 35 opens into the chamber 31 for leading pressurized fluid into (and/or out of) the chamber 31.

Both the housing 28 and the plug 32 may be made of the same material, e.g. metal, or from different materials, for instance from different metals or one of them may be of plastics and the other of metal.

The vertex angle of the tapered plug 32, which has the shape of a frustrum of a right circular cone, is in the range of 15° to 45°, preferably 20° to 25°, and its axis extends to the bottom surface of the housing 28 (and also the top and bottom surfaces of the baseplate 12) at an angle corresponding to one half of the vertex angle, i.e. to an angle between the axis of the plug and any of the generators of its surface. As a consequence, the portion of the housing 28 between the plug 32 and the baseplate 12 below the axis of the plug 32 is uniformly thick. The axis of the nozzle 26 and the axis of the plug 32 intersect each other.

The valve 30 is designed to control and cut off the flow of both the solids 18 and liquid 20 and consequently comprises two separate flow systems, namely a solids flow system and a liquid flow system.

The solids flow system comprises a first chamber 46 which extends axially, is open at the narrow front end of the plug 32 and communicates with a radial port 48 in the side of the plug 32. The solids flow system also includes an inlet port provided in the housing 28 and communicating with the outlet end of a solids feed pipe 52 the inlet end of which communicates with a sterile source of solids (not shown).

The liquid flow system comprises a second chamber 42 which communicates directly with ports 40 and 44 and via a longitudinal passage 54 (FIG. 5) with a port 46 in which a spray nozzle 58 provided with a plurality of small openings therethrough is detachably secured by a long stud 60. The purpose of the small openings is to prevent undesirable outflow of the liquid after completed discharge stroke of the liquid metering pump 24. The ports 40, 44 and 56 are radial ports in the side of the plug 32. In the illustrated embodiments the axes of the ports 40 and 44 are contained in a first radial plane of the plug 32 and are spaced through an angular distance o, while the ports 48 and 56 are contained in a second radial plane of the plug 32 and are spaced through an angular distance o. In the illustrated example the radial distance o is 90°. The liquid flow system also includes ports 88 and 37 provided in the housing 28 and spaced through an angular distance o. The port 37 is an inlet port communicating with the outlet end of a liquid feed pipe 36 the inlet end of which communicates with a sterile source of liquid (not shown).

Both the flow systems have a common outlet port 49 in the housng 28. The outlet port 49 communicates with the filling nozzle 26.

As seen in FIGS. 1, 3, 5, 8 and 9, the solids metering pump 22 is mounted on the base plate 12 via a hollow mounting block 84. The block 84 is provided with a conduit 15 which communicates at one end with the open end of the tapered bore 29 and thereby with the chamber 46 and at the other end, via a valve (not shown) with an outlet (not shown). The block 84 is further provided with a profiled port 86 which is offset from the axis of the pump 22 and through which the pump 22 communicates with the conduit 15. The liquid metering pump 24 communicates through the port 88 in the housing 28 with the tapered bore 29.

Figure 2:
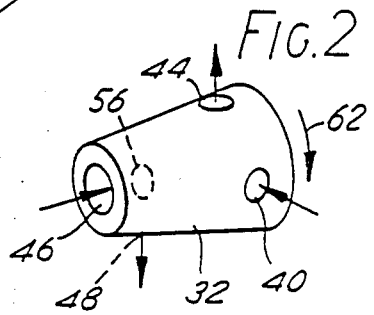
FIG. 2 shows a plug of the valve in the solids filling mode.
Figure 4:
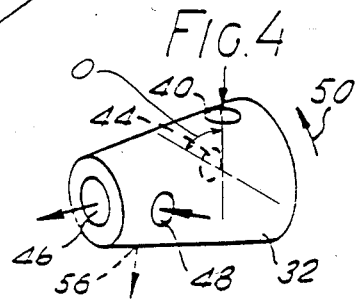
FIG. 4 shows the plug in the liquid filling mode.
Figure 5:
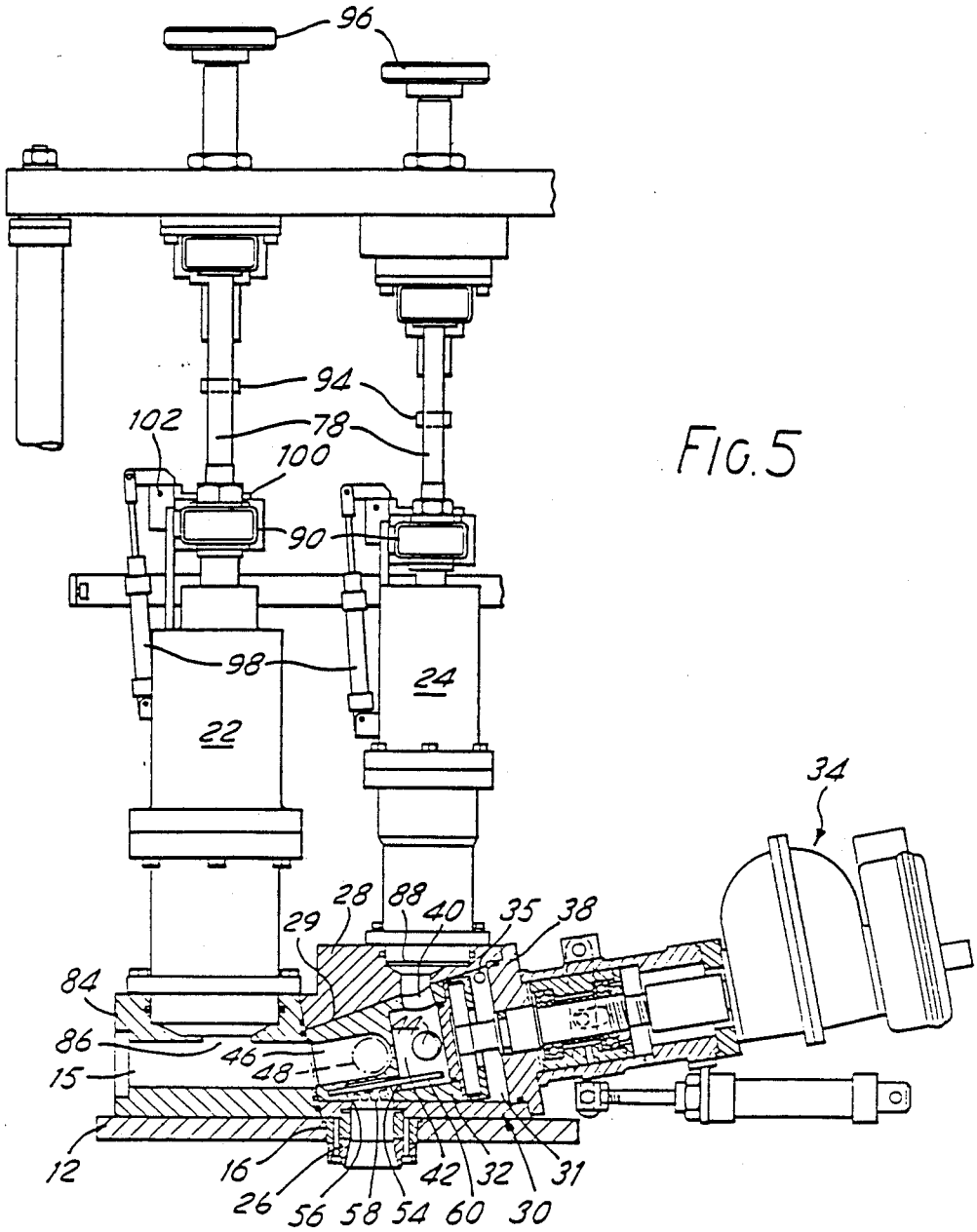
FIG. 5 is a side elevation, partly in section, of the machine in its liquid filling mode.
Figure 6:
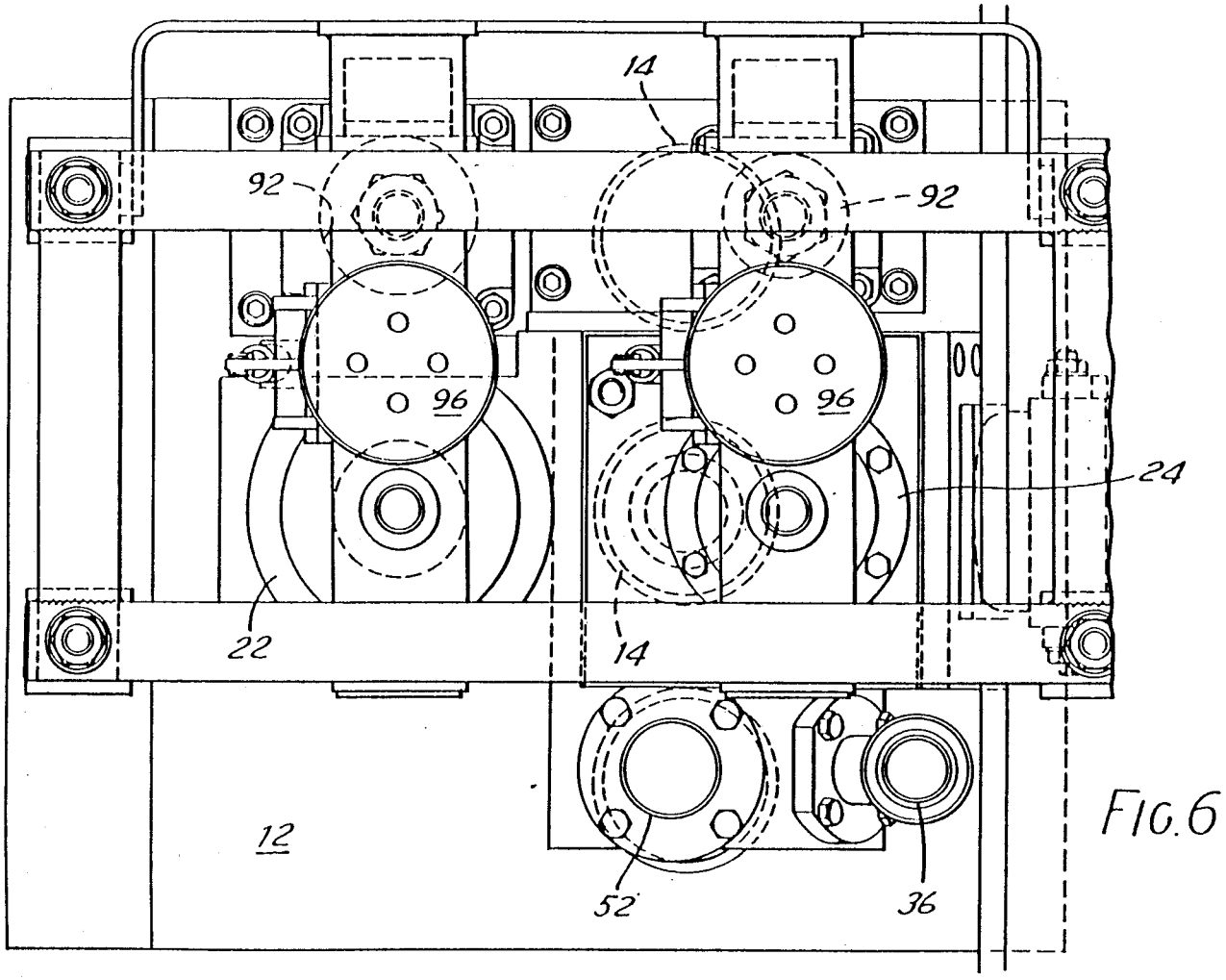
FIG. 6 is a plan to FIG. 5.

The plug 32 is rotatably displaceable through an angular distance o between two angular positions by a suitable rotary actuator 34 (FIG. 5). These two positions are a first position, shown in FIGS. 1 and 2, and a second position shown in FIGS. 3, 4 and 5. In both positions, the chamber 46 in the plug 32 communicates with the conduit 15 and thereby, via the port 86, with the pump 22.

When the filling machine is in its solids filling mode (FIG. 1), the plug 32 is in the first position, in which the port 40 is aligned with the inlet port 37 while the port 44 is aligned with the port 88, so that the liquid feed pipe 36 communicates via the ports 37 and 40, the chamber 42 and the ports 44 and 88 with the liquid metering pump 24 which is in the suction mode so that the liquid 20 is supplied thereto from the sterile source of liquid. In this position the port 56 is sealed off by the surface of the tapered bore 29. At the same time, the port 48 is aligned with the outlet port 49 so that the filling nozzle 26 communicates with the solids metering pump 22 which is in the discharge mode and consequently is delivering solids 18, via the port 86, conduit 15, chamber 46, outlet ports 48 and 49 and the nozzle 26, into the cup 14 below the nozzle 26.

Figure 3:
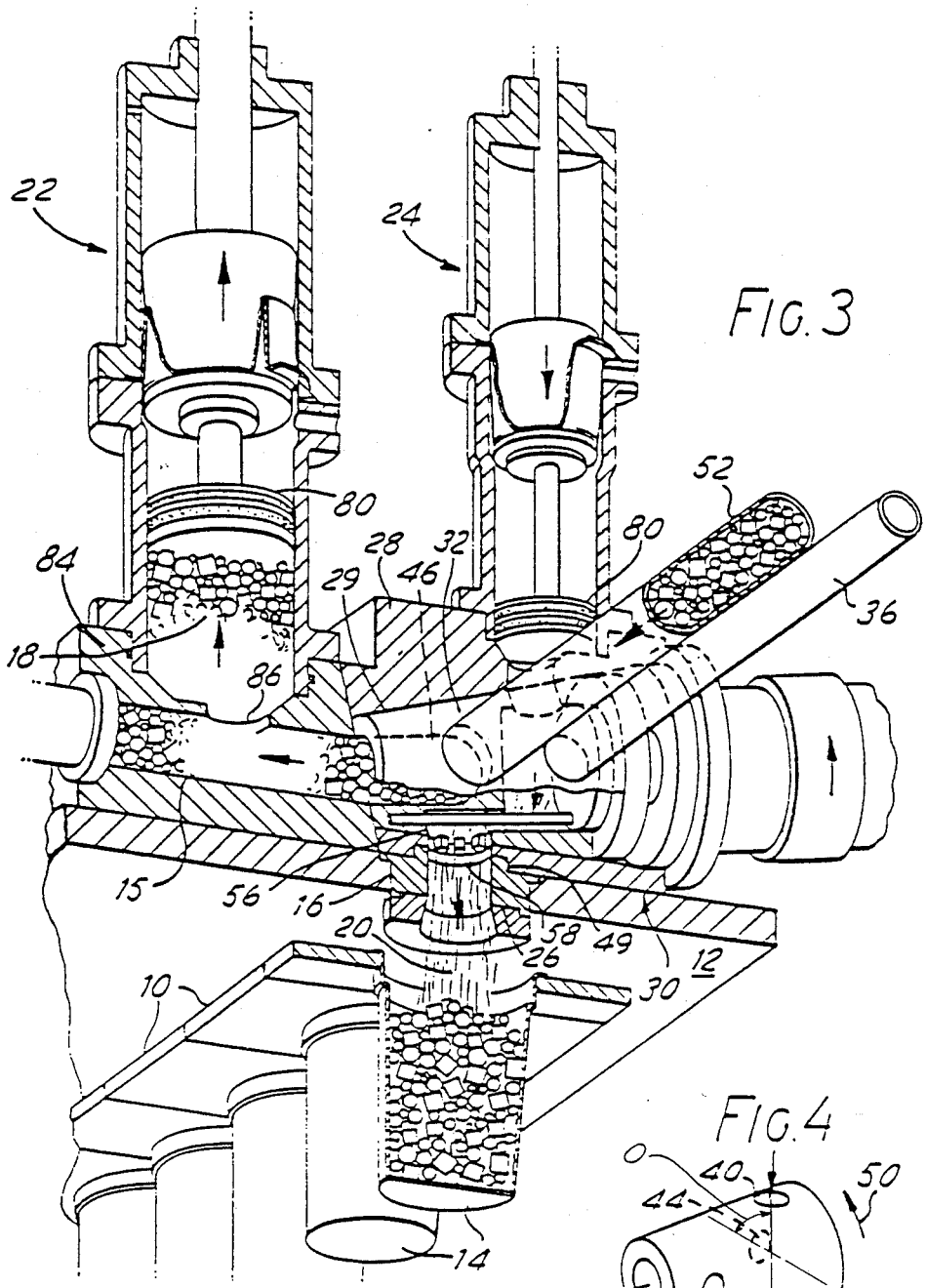
FIG. 3 shows the machine in its liquid filling mode.

When the delivery of solids into the cup 14 is completed, the filling machine is switched over to its liquid filling mode (FIGS. 3 and 5). For this purpose the core 32 is rotated to the second position as indicated by arrow 50 in FIG. 4. In this position the port 48 is aligned with the inlet port 53 so that the solids feed pipe 52 communicates via the ports 53 and 48, the chamber 46, conduit 15 and port 86 with the solids metering pump 22, which is now in the suction mode so that the solids 18 are supplied thereto from the sterile source of solids. In this position the port 40 registers with the port 88, the port 44 is sealed off by the surface of the tapered bore 29, and the port 46 is in register with the outlet port 49 so that the filling nozzle 26 communicates with the liquid metering pump 24, which is in the discharge mode and consequently is delivering liquid 20, via the ports 88 and 40, chamber 42, the passage 54, ports 56 and 49, and the nozzle 26, into the cup 14 which has been filled with solids.

The port 86 is preferably designed to direct the solids, without blockage, in the direction towards the valve 30 when the pump 22 is discharging.

When delivery of the liquid stops, the filling machine is switched over to its solids filling mode. For this purpose the plug 32 is rotated in the opposite direction (see arrow 62, FIG. 2), to restore it to its first position. Indexing of the pot carriers 10 to present a new empty pot 14 to the nozzle 26 takes place before the plug 32 is rotated, after which the new pot 14 is filled with solids and then liquid as described above.

As is apparent from the preceding description, mixing takes place in the container 14 itself and not normally in the filling machine (though an arrangement is not excluded in which, while one pump is being charged, two or more other pumps are simultaneously discharging into the container via a common mixing chamber in the control valve or upstream of it).

In the case where two pumps 22, 24 are used, each pump is being charged (suction mode) while the other is being discharged (discharge mode), movement of the control valve plug 32 between its two positions being timed so as to bring, at or just after the end of the charging stroke of the pump being charged, that pump into communication with the container. This gives a "seesaw" action to the pumps, and enables mixed products to be packaged quickly.

Figure 7:
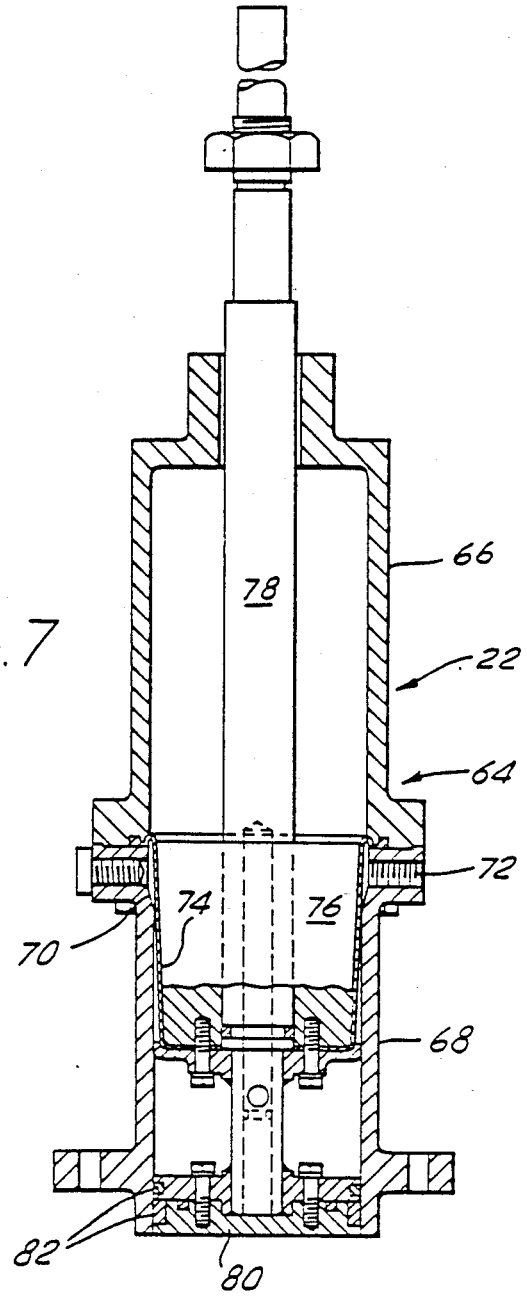
FIG. 7 is an axial section of one of the pumps.

The two pumps 22 and 24 are preferably of generally similar construction, for example as shown in FIG. 7, having a cylinder 64 formed from an upper block 66 and a lower block 68. The latter is tapered at its top end (as shown at 70) to a larger bore, the upper block 66 having the same larger bore. At the taper 70 is a radial inlet and outlet connection 72 for communicating with the lower block 68 of the cylinder 64. The cylinder is divided into an upper part and a lower part by a rolling diaphragm 74 whose outer flange is clamped between the two cylinder blocks 66, 68 and whose top surface is at its central portion secured to an upper piston 76 which supports the diaphragm 74 and is situated above it. Piston 76 is carried on a piston rod 78 having a working piston 80 at its front end. The piston 80 has sliding seals 82 and slides in the reduced bore of the lower cylinder block 68. Due to this arrangement the upper piston 76 is always contained in the upper part, while the working piston 80 is always contained in the lower part.

The seals 82 provide primary sealing against ingress of product into the cylinder 64 above the piston 80, and greatly reduce the chance of damage to the diaphragm 74 by abrasive elements in the product. The diaphragm 74 itself not only provides a secondary seal against ingress of product, but also serves as a barrier between the sterile lower part of the cylinder 64 and its upper part which is not in a sterile environment. Sterile fluid, such as sterile air, is introduced during normal operation through the connection 72 into the sterile lower part of each cylinder between the diaphragm 74 and the piston 80 not only to keep that part sterile but also to prevent the product component pumped therein from getting past the piston 80 and its seals 82 above the piston 80.

Each pump 22, 24 has a transverse yoke 90 mounted on its piston rod 78 and coupled with a double-acting fluid actuator 92 to raise and lower its pistons 76, 80. The length of the piston stroke of each pump 22 and 24 is adjustable independently by any suitable means. FIG. 5 shows one possible arrangement, in which the upper limit is set by a stop 94 adjustable by a manual wheel 96. An actuator 98 for each pump controls a plate 100 pivoted at 102 on a fixed bracket. When in the position shown in FIG. 5, the plate 100 prevents the yoke 90 from rising until such time as it is necessary to raise the piston clear of the narrower base for sterilizing.

Figure 8:
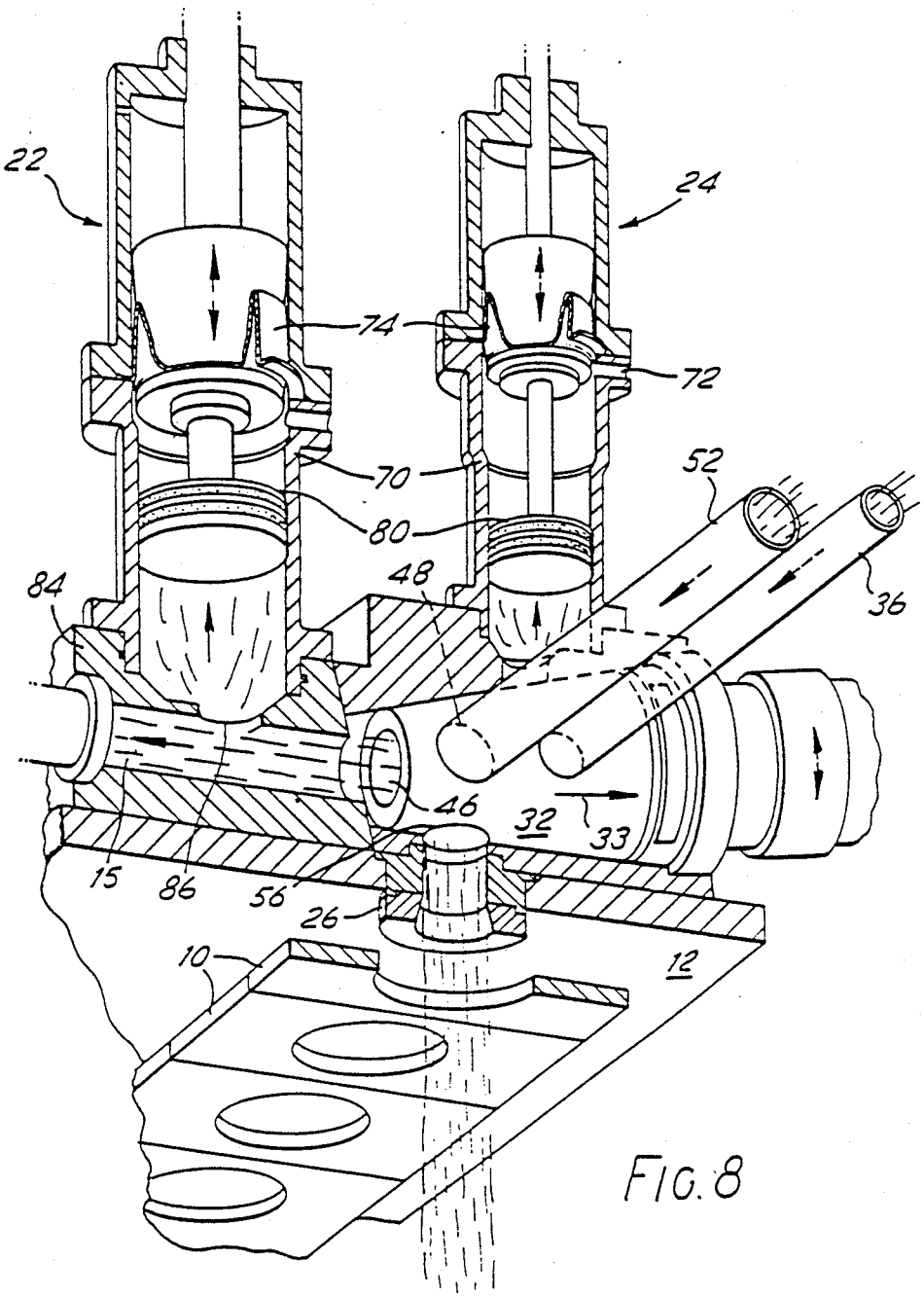
FIG. 8 shows the machine in its cleaning mode.

Periodically the equipment needs cleaning and sterilizing. FIG. 8 shows the cleaning mode, in this example by washing (though steam purging may be used instead). Washing fluid is introduced simultaneously through the feed pipes 36, 52, which are temporarily disconnected from the sterile sources of liquid and solids and are connected to a source of washing fluid, and the plug 32 is oscillated repeatedly back and forth between its two positions, while the pistons 80, 76 of the pumps 22, 24 are reciprocated repeatedly up and down. Wash effluent escapes through the conduit 15 (to the left in FIG. 8) and through the nozzle 26.

Figure 9:
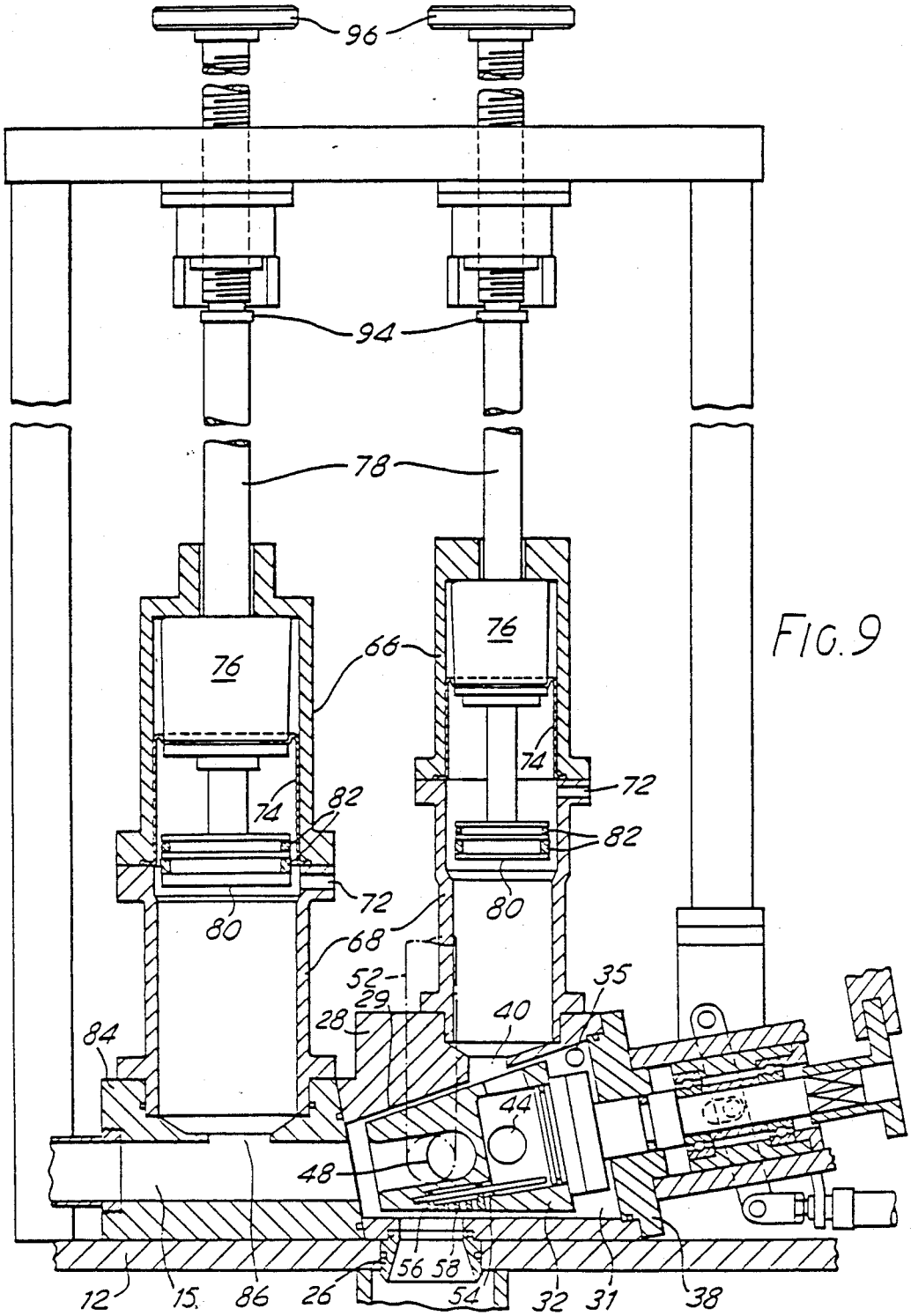
FIG. 9 is a section side elevation showing the machine in its sterilization mode with the plug of the valve and pistons of the pumps withdrawn.

During the last part of the washing phase, the plug 32 is withdrawn in the direction of arrow 33 axially to provide clearance between the mating surfaces of the plug 32 and bore 29 but retaining a clearance between the rear face of the plug 32 and the closing plate 38, so that all surfaces of the plug 32 are exposed for cleaning and subsequent sterilisation. Also, both the working pistons 80 are withdrawn, i.e. raised above the level of the tapers 70 into their enlarged chambers to the same position as shown in FIG. 9, to provide clearance between the pistons 80 with their seals 82 and the inner surface of the cylinder 64. Sanitizing fluid is then introduced under pressure so that it contacts all internal surfaces and penetrates as far as the diaphragms 74. The steps used in the cleaning mode (washing, rinsing, sanitizing) and the fluids used therefor depend on the product components used for filling. After non-greasy components washing with a washing fluid might be satisfactory.

After completed washing and with pistons 80 and plug 32 retained in their withdrawn positions sterilization can be carried out as shown in FIG. 9. For this purpose steam is introduced through the channel 35 into the chamber 31 and from there flows around the plug 32 and around the pistons 80 and leaves through the connections 72. While cleaning is performed after filling shift, sterilization is performed before a filling shift.

We claim:

1. A machine for filling packaging containers with a flowable product wherein the product has first and second components, the machine comprising a control valve in the form of a plug valve having a body defining a bore having a frusto-conical valve seat, a frusto-conical plug having a frusto-conical surface, said valve seat having a frusto-conical surface complementary with said plug, a valve chamber for pressurized fluid being formed at the wider end of the plug, the chamber communicating with the bore, the plug being axially displaceable between a first position, in which its frusto-conical surface seals against the valve seat and in which it is rotatable to control flow through the valve, and a second position, in which it is withdrawn into the chamber to provide clearance between the surfaces of the plug and the seat but retaining clearance between its wider end and the surfaces of the chamber so that all surfaces of the plug are exposed for cleaning and sterilization.

2. A machine according to claim 1 comprising conduit means communicating with the valve chamber for leading the pressurized fluid into and/or out of the chamber.

3. A machine according to claim 1 or 2 wherein the product has two components and wherein the plug comprises two separate flow paths for discretely directing the flow of each of said two components of the flowable product therethrough.

4. A machine according to claim 1 comprising a first and a second pump for pumping, respectively, said first and second components of said product, where the first and second components are of first and second sterile sources, and the machine is provided with a common outlet for filling the containers, respective flow paths for the components between the pumps and said respective sterile sources of the components and between the pumps and said common outlet for filling the containers, wherein the plug valve is constructed and situated to control the flow of the components through the flow paths and is angularly displaceable between a first position in which the first pump is in a discharge mode and discharges the first component via the plug into the outlet, and the second pump is in a suction mode and fills itself with the second component from the second source via the plug, and a second position in which the operation of the pumps is reversed such that the first pump is in a suction mode and the second pump is in a discharge mode.

5. A machine according to claim 4 wherein each of the pumps is a single-action reciprocating piston pump which comprises a cylinder, a main piston and an auxiliary piston carried by a common piston rod, wherein the cylinder is fluid-tightly divided by a rolling diaphragm into a main part containing the main piston and an auxiliary part containing the auxiliary piston, the periphery of the rolling diaphragm being attached to the cylinder and a central portion of the diaphragm is attached to the auxiliary piston to be displaced by the auxiliary piston.

6. A machine according to claim 5 wherein the main part of the cylinder has a pumping portion, the diameter of which is complementary to the diameter of the main piston, and a withdrawal portion, which merges into the pumping portion and is of a larger diameter than the pumping portion, each said pump being so designed that it has a pumping mode in which the main piston is reciprocable within the pumping portion, while outside the pumping mode the main piston may be withdrawn into the withdrawal portion in which its surfaces are exposed for cleaning and sterilization.

* * * * *

UNITED STATES PATENT AND TRADEMARK OFFICE

CERTIFICATE OF CORRECTION

PATENT NO. : 4,913,202

DATED : April 3, 1990

INVENTOR(S) : John D. Miller; Peter D. Hardy

It is certified that error appears in the above-identified patent and that said Letters Patent is hereby corrected as shown below:

On the title page:

Abstract, line 4, change "complimentary" to -- complementary --.

Column 1, line 19, change "petfood" to -- pet food --.
Column 1, line 63, change " O " rings" to -- O-ring --.

Column 2, line 19, change "singleacting" to -- single-acting --.

Column 3, line 23, change " O " ring" to -- O-ring --.
Column 3, line 39, change "plastics" to -- plastic --.
Column 3, line 66, change "46" to -- 56 --.

Column 4, line 68, change "46" to -- 56 --.

Column 6, line 56, change "having" to -- forming --.

Signed and Sealed this

Thirty-first Day of March, 1992

*Attest:*

HARRY F. MANBECK, JR.

*Attesting Officer*

*Commissioner of Patents and Trademarks*